US008919638B2

(12) United States Patent
McCormick

(10) Patent No.: US 8,919,638 B2
(45) Date of Patent: Dec. 30, 2014

(54) TRANSPARENT DISPLAY SLEEVE FOR MAILBOX

(71) Applicant: Kevin Paul McCormick, Brick, NJ (US)

(72) Inventor: Kevin Paul McCormick, Brick, NJ (US)

( * ) Notice: Subject to any disclaimer, the term of this patent is extended or adjusted under 35 U.S.C. 154(b) by 106 days.

(21) Appl. No.: 13/840,518

(22) Filed: Mar. 15, 2013

(65) Prior Publication Data

US 2014/0087103 A1 Mar. 27, 2014

Related U.S. Application Data

(60) Provisional application No. 61/704,609, filed on Sep. 24, 2012.

(51) Int. Cl.
*A47G 29/14* (2006.01)
*A47G 29/122* (2006.01)

(52) U.S. Cl.
CPC ..... *A47G 29/122* (2013.01); *A47G 29/1209* (2013.01)
USPC ..... 232/33; 40/606.6; 428/34.1; 428/35.2

(58) Field of Classification Search
USPC ..... 232/33; 40/606.6; 428/34.1, 35.2
See application file for complete search history.

(56) References Cited

U.S. PATENT DOCUMENTS

2002/0092901 A1* 7/2002 Paschal ..... 232/38

* cited by examiner

*Primary Examiner* — Michael C Miggins

(57) ABSTRACT

A mailbox display sleeve may include an inside layer and an outside layer joined at a crease. The outside layer may be made of a clear plastic material. An attachment component may attach the inside layer to an outside surface of a mail box. An insert may fit in between the inside layer and the outside layer of the display sleeve, and may thereby be displayed from the mailbox.

10 Claims, 4 Drawing Sheets

TRANSPARENT DISPLAY SLEEVE FOR MAILBOX

BACKGROUND OF THE INVENTION

The present invention relates to mailbox accessories, and more specifically, to a transparent display sleeve for the outside surface of a standard mailbox, which allows a user to personalize their mailbox.

Standard US Postal Service Mailboxes are very functional, but their plain appearance is not pleasing for many. Some people attempt to decorate their mailbox with paint, decals, stickers and the like, but these decorative elements are substantially permanent, and therefore not easily replaced or removed when they become damaged by the elements, or when the owner otherwise wants to update the look. Some people use preprinted mailbox covers to enhance the look of their mailbox, but these covers are expensive and not easily personalized.

As can be seen, there is a need for a device which facilitates mailbox personalization and decoration.

SUMMARY OF THE INVENTION

In one aspect of the present invention, a display sleeve for a mailbox comprises: a mailbox sleeve comprising an inside layer and an outside layer joined together at a crease to form an envelope, pouch or sleeve, wherein at least the outside layer is formed of a clear material; and an attachment component that attaches the inside layer to an outside surface of the mailbox.

These and other features, aspects and advantages of the present invention will become better understood with reference to the following drawings, description and claims.

DETAILED DESCRIPTION OF THE INVENTION

Figure 1:
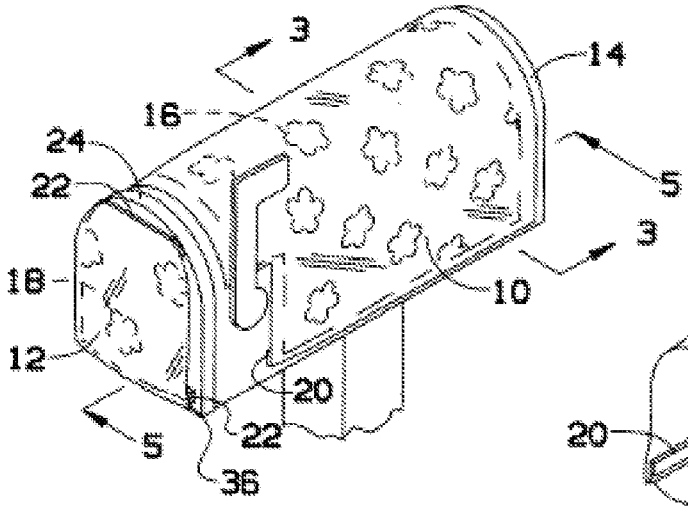
FIG. 1 is a perspective view of the present invention, shown in use.
Figure 2:
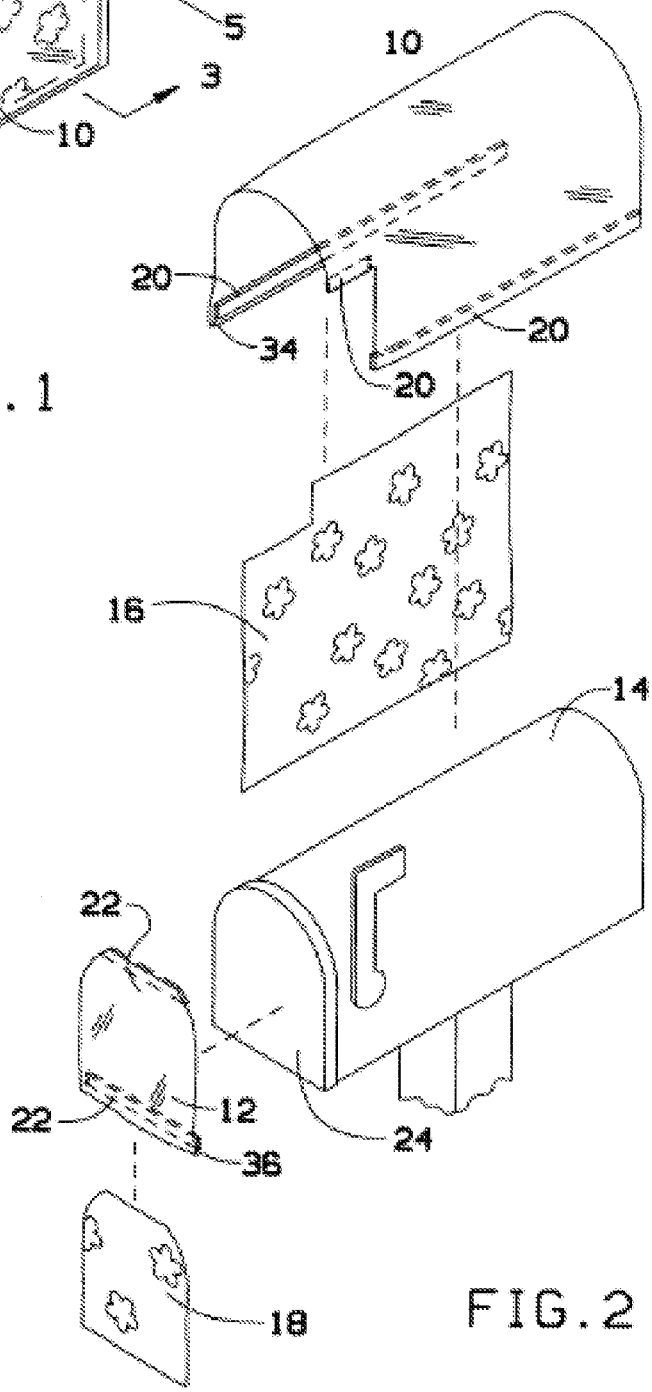
FIG. 2 is an exploded perspective view of the present invention, shown in use.
Figure 3:
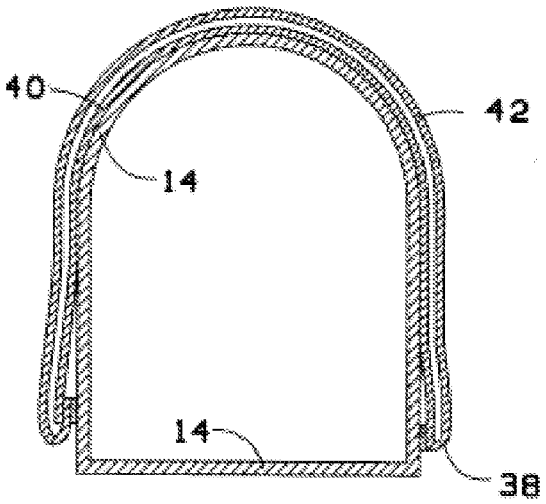
FIG. 3 is a section view of the present invention, taken along line 3-3 in FIG. 1, with the insert omitted.
Figure 4:
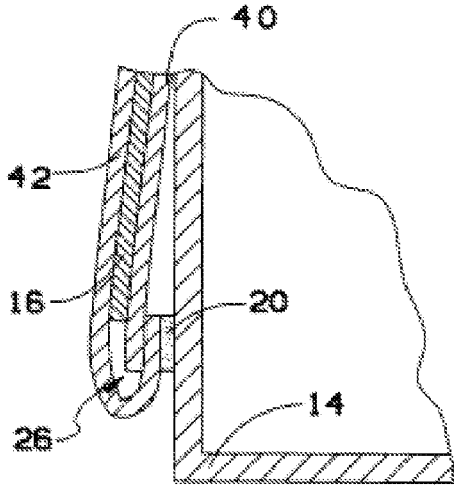
FIG. 4 is a detail sectional view of the present invention.
Figure 5:
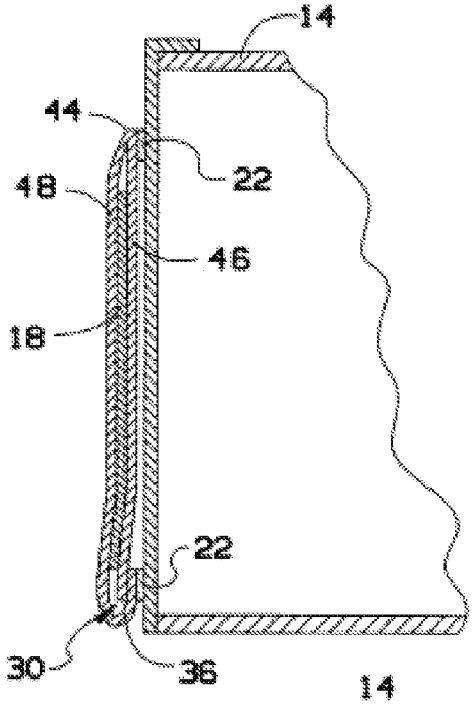
FIG. 5 is a sectional view of the present invention, taken along line 5-5 in FIG. 1.
Figure 6:
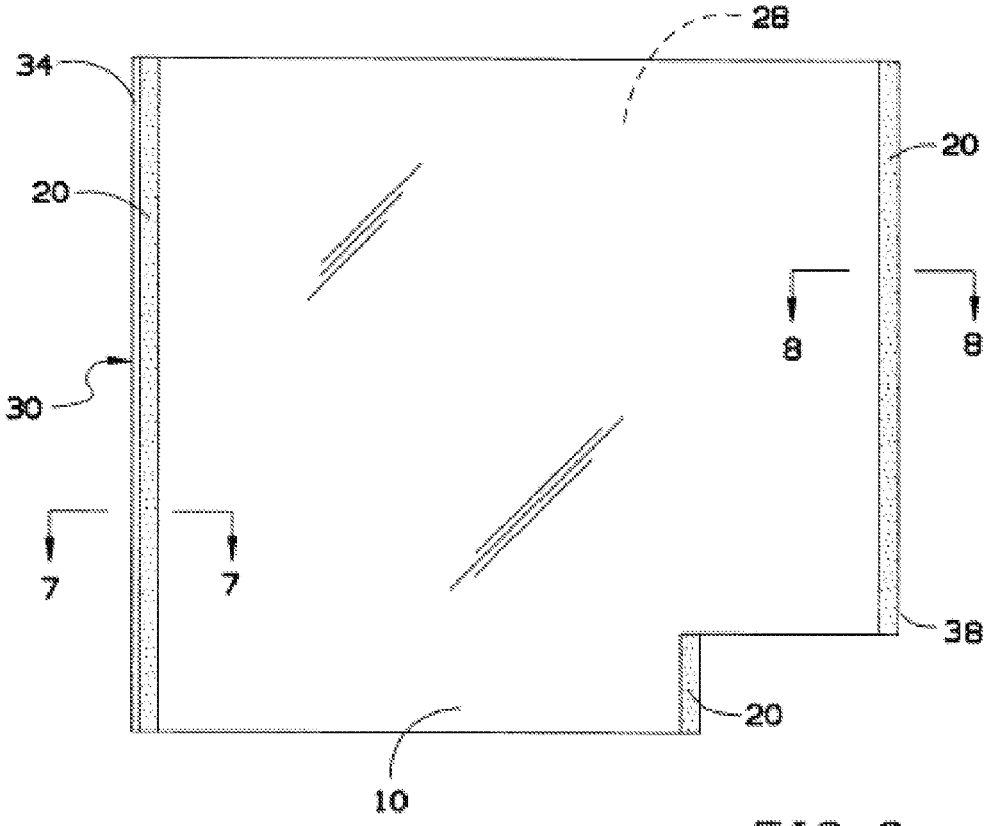
FIG. 6 is a top view of the mailbox sleeve, laid flat.
Figure 7:
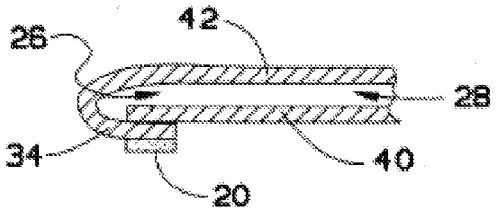
FIG. 7 is a sectional view of the present invention, taken along line 7-7 in FIG. 6.
Figure 8:
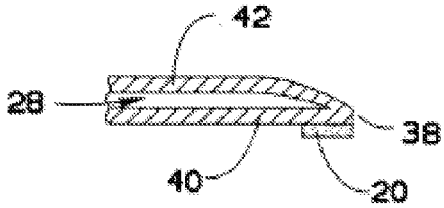
FIG. 8 is a sectional view of the present invention, taken along line 8-8 in FIG. 6.
Figure 9:
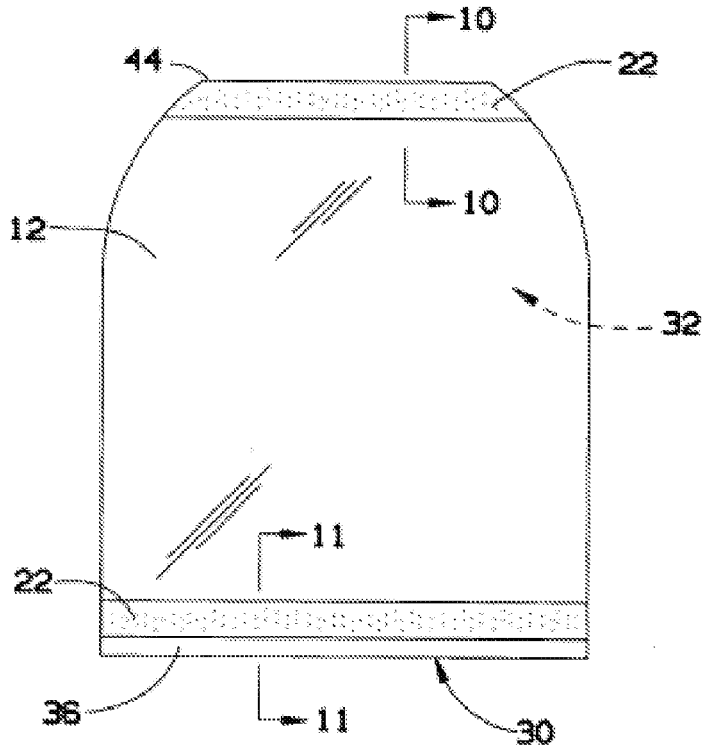
FIG. 9 is a rear view of the door sleeve.
Figure 10:
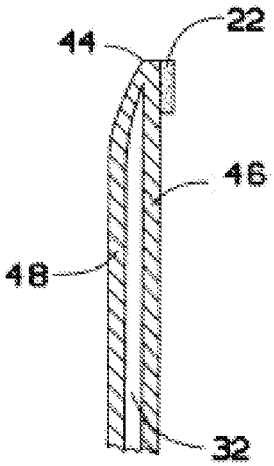
FIG. 10 is a section view of the present invention, taken along line 10-10 in FIG. 9.
Figure 11:
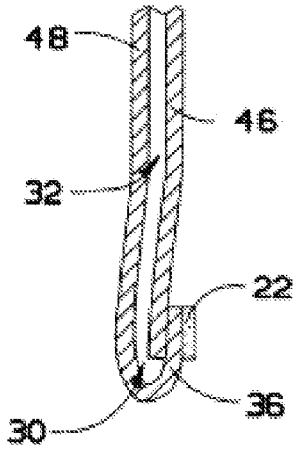
FIG. 11 is a section view of the present invention, taken along line 11-11 in FIG. 9.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a display sleeve that may include an inside layer and an outside layer joined at a crease. The outside layer may be made of a clear plastic material. An attachment component may attach the inside layer to an outside surface of a mailbox. An insert may fit in between the inside layer and the outside layer of the display sleeve, and may thereby be displayed from the mailbox.

The present invention may include a reusable mailbox cover sleeve that allows a user to change the design of their mailbox. The sleeve of the present invention may include a clear protective covering. An insert may be placed within the mailbox cover sleeve to be displayed from the mailbox. The cover may be attached to the mailbox by an impermanent and reusable attachment component.

The insert may be any flat design, advertisement or artwork that is either made by the user or purchased. Once the artwork, design or advertisement is inside the mailbox cover sleeve, the cover sleeve may be attached to the outside surface of the mailbox by an attachment device, and the insert may be displayed. The insert inside of the mailbox cover sleeve may be easily changed. The user may remove the cover sleeve from the mailbox, open up the clear protective sleeve, and exchange the new and the old inserts. The inserts may also include numbers or messages on them. For example, the mailbox may be used as a sign post for a number of things such as, but not limited to, real estate, house numbers, locations, and other informative messages.

Referring to claims 1 through 11, the present invention may include a mailbox sleeve 10. The mailbox sleeve 10 may fit around the body of a mailbox 14. The sleeve 10 may include an inside layer 40 and an outside layer 42. The inside layer 40 and the outside layer 42 may join together at crease 38. In certain embodiments, the inside layer 40 and the outside layer 42 may join together at five sides, including the crease 38. In between the inside layer 40 and the outside layer 42 may be a mailbox sleeve pocket 28.

In certain embodiments, the inside layer 40 and the outside layer 42 may be two separate sheets that may be fastened together at the crease 38. The outside layer 42 may be a sheet of clear material, such as a clear plastic. The inside layer 40 may be a clear material or colored material. For example, the inside layer 40 may be the color of the mailbox. In certain embodiments, the mailbox sleeve 10 may be a single sheet, and the crease 38 may be a fold, in which the outside layer 42 is folded over the inside layer 40.

On the opposite end of the crease 38 may be the mailbox sleeve opening 26. The mailbox opening 26 is where one may open and access the mailbox sleeve pocket 28. The mailbox opening 26 may include the outside layer 42 folding over the inside layer 40, creating a mailbox sleeve flap 34. The mail box sleeve flap 34 may thereby surround an end of the inside layer 40. A mailbox insert 16 may be inserted into the mailbox sleeve pocket 28 at the mailbox opening 26 and may be in between the inside layer 40 and the outside layer 42.

In certain embodiments, the present invention may include a mailbox attachment component 20. The mailbox attachment component 20 may be impermanent and re-usable. The attachment component 20 may include, but is not limited to, a hook and loop fastener, a re-usable glue, tack putty, tape, a button fastener and the like. For example, a hook strip may be attached to the mailbox and a loop strip may be attached to the mailbox sleeve 10. The attachment component 20 may be located at attachment points on the mailbox sleeve. For example, the attachment points may include the mailbox sleeve flap 34 and the mailbox sleeve crease 38. In certain embodiments, the attachment point may be a substantial length of the mailbox sleeve flap 34 and the mailbox sleeve crease 38.

In certain embodiments, the mailbox sleeve 10 may further include a cutout portion. For example, the inside layer 40 and the outside layer 42 may have a corresponding cutout portion. The cut out portion may be used to accommodate and surround a mailbox flag.

The present invention may include a door sleeve 12. The door sleeve 12 may be attached to a door 24 of a mailbox 14. The door sleeve 12 may include a door sleeve inside layer 46 and a door sleeve outside layer 48. The door sleeve inside layer 46 and the door sleeve outside layer 48 may join together at a door sleeve crease 44. In between the door sleeve inside layer 46 and the door sleeve outside layer 48 may be a door sleeve pocket 32.

In certain embodiments, the door sleeve inside layer 46 and the door sleeve outside layer 48 may be two separate sheets that may be fastened together at the door sleeve crease 44. The door sleeve outside layer 48 may be a sheet of clear material, such as a clear plastic. The door sleeve inside layer 46 may be a clear material or colored material. For example, the door sleeve inside layer 46 may be the color of the mailbox. In certain embodiments, the door sleeve 12 may be a single sheet, and the crease 44 may be a fold, in which the door sleeve outside layer 48 is folded over the door sleeve inside layer 46.

On the opposite end of the door sleeve crease 44 may be the door sleeve opening 30. The door sleeve opening 30 is where one may open and access the door sleeve pocket 32. The door sleeve opening 30 may include the door sleeve outside layer 48 folding over the door sleeve inside layer 46, creating a door sleeve flap 36. The door sleeve flap 36 may thereby surround an end of the door sleeve inside layer 46. A door insert 18 may be inserted into the door sleeve pocket 32 at the door sleeve opening 30, and may be oriented in between the door sleeve inside layer 46 and the door sleeve outside layer 48.

The door sleeve 12 may include a door attachment component 22. The door attachment component 22 may be impermanent and re-usable. The door attachment component 22 may include, but is not limited to, a hook and loop fastener, a re-usable glue, tack putty, tape, a button fastener and the like. For example, a hook strip may be attached to the door of the mailbox 14 and a loop strap may be attached to the door sleeve 12. The door sleeve attachment component 22 may be located at attachment points on the door sleeve 12. For example, the attachment points may include the door sleeve flap 36 and the door sleeve crease 44. In certain embodiments, the attachment point may be a substantial length of the door sleeve flap 36 and the door sleeve crease 44.

It should be understood, of course, that the foregoing relates to exemplary embodiments of the invention and that modifications may be made without departing from the spirit and scope of the invention as set forth in the following claims.

What is claimed is:

1. A display sleeve for a mailbox comprising:

a mailbox sleeve comprising an inside layer and an outside layer joined at a crease to form a pocket in between the inside layer and the outside layer, wherein at least the outside layer is formed of a clear material; and an attachment component that is configured to attach the inside layer to an outside surface of the mailbox.

2. The display sleeve of claim 1, further comprising an insert in between the outside layer and the inside layer.

3. The display sleeve of claim 1, wherein a corner of the mailbox sleeve comprises a cut out portion and is thereby configured to fit around a mailbox flag.

4. The display sleeve of claim 1, wherein the mailbox sleeve is a door sleeve and is configured to fit onto a door of the mailbox.

5. The display sleeve of claim 1, wherein the attachment component is an impermanent and reusable attachment component.

6. The display sleeve of claim 5, wherein the attachment component is selected from the group consisting of a hook and loop fastener, a re-usable glue, a tack putty, tape, and a button fastener.

7. The display sleeve of claim 6, wherein a hook strip is attached to the mailbox and a loop strap is attached to the mailbox sleeve.

8. The display sleeve of claim 1, wherein at an opposite end of the crease, an end of the outside layer and an end of the inside layer meet to form a mailbox sleeve opening.

9. The display sleeve of claim 8, wherein the mailbox sleeve opening comprises the end of the outside layer folding over the end of the inside layer, thereby forming a mailbox sleeve flap surrounding the end of the inside layer.

10. The display sleeve of claim 9, wherein the mailbox sleeve flap substantially comprises the attachment component and the crease substantially comprises the attachment component.

* * * * *